US012163319B2

(12) United States Patent
Banham et al.

(10) Patent No.: US 12,163,319 B2
(45) Date of Patent: Dec. 10, 2024

(54) SHOWER HEAD WITH MULTIPLE VALVES AND MULTIPLE OUTLETS

(71) Applicant: KOHLER MIRA LIMITED, Cheltenham (GB)

(72) Inventors: Stuart Banham, Cheltenham (GB); Charlie Parker, Cheltenham (GB); James Bourne, Cheltenham (GB); Robin Whitfield, Cheltenham (GB); Craig Fitton, Cheltenham (GB)

(73) Assignee: Kohler Mira Limited, Cheltenham (GB)

( * ) Notice: Subject to any disclaimer, the term of this patent is extended or adjusted under 35 U.S.C. 154(b) by 0 days.

(21) Appl. No.: 18/179,677

(22) Filed: Mar. 7, 2023

(65) Prior Publication Data

US 2023/0295907 A1 Sep. 21, 2023

(51) Int. Cl.
*E03C 1/05* (2006.01)
*E03C 1/02* (2006.01)
(Continued)

(52) U.S. Cl.
CPC ..... *E03C 1/055* (2013.01); *E03C 1/0404* (2013.01); *E03C 1/044* (2013.01); *E03C 2001/026* (2013.01); *Y10T 137/9464* (2015.04)

(58) Field of Classification Search
CPC ..... E03C 1/055; E03C 1/04; E03C 1/0404; E03C 1/044; E03C 2001/026; Y10T 137/9464
(Continued)

(56) References Cited

U.S. PATENT DOCUMENTS 2,949,109 A 8/1960 Koolnis
4,756,030 A * 7/1988 Juliver ..... E03C 1/055 4/677
(Continued)

FOREIGN PATENT DOCUMENTS

CN 101099008 A * 1/2008 ..... E03C 1/0404
GB 2599957 A * 4/2022 ..... E03C 1/021
(Continued)

OTHER PUBLICATIONS

CN-101099008-A—Translation (Year: 2008).*
European Search Report dated Aug. 9, 2023 received in the corresponding European Patent Application.

*Primary Examiner* — Daphne M Barry
(74) *Attorney, Agent, or Firm* — Husch Blackwell LLP

(57) ABSTRACT

A plumbing system is provided with a digital mixer valve providing a principal stream having a controlled temperature and flow rate. A fluid delivery device is also provided downstream of the digital mixer valve, the fluid delivery device having two or more sets of outlets, each of the two or more sets of outlets comprising at least two outlets, and having an outlet operating valve being disposed upstream of each set of outlets and being operable to control fluid flow to the set of outlets downstream thereof. A communication link is also provided between the digital mixer valve and the outlet operating valves. The digital mixer valve is configured, in use, to adjust the temperature and flow rate of the principal stream in dependence upon which set of outlets or combination of sets of outlets is in operation at a given time.

20 Claims, 3 Drawing Sheets

(51) Int. Cl.
*E03C 1/04* (2006.01)
*E03C 1/044* (2006.01)

(58) Field of Classification Search
USPC ..... 137/801
See application file for complete search history.

(56) References Cited

U.S. PATENT DOCUMENTS

| | | | | |
|---|---|---|---|---|
| 9,632,514 | B2 * | 4/2017 | Marty | G05D 11/13 |
| 10,626,583 | B2 | 4/2020 | Mazz et al. | |
| 11,668,079 | B2 * | 6/2023 | Wales | B05B 12/04 137/861 |
| 2018/0298596 | A1 | 10/2018 | Tsai | |

FOREIGN PATENT DOCUMENTS

| | | | | | |
|---|---|---|---|---|---|
| GB | 2599959 | A | * | 4/2022 | E03B 7/12 |
| GB | 2612387 | A | * | 5/2023 | E03C 1/0408 |
| WO | WO-9529300 | A1 | * | 11/1995 | E03C 1/04 |
| WO | WO-2007026153 | A1 | * | 3/2007 | E03C 1/055 |
| WO | WO-2011094455 | A1 | * | 8/2011 | E03C 1/05 |
| WO | WO-2017214308 | A1 | * | 12/2017 | A47K 3/28 |

* cited by examiner

SHOWER HEAD WITH MULTIPLE VALVES AND MULTIPLE OUTLETS

CROSS REFERENCE

This application claims priority to UK Application No. GB2203711.3, filed Mar. 17, 2022, the entirety of which is hereby incorporated by reference.

FIELD OF THE INVENTION

This disclosure relates to plumbing systems, in particular to plumbing systems comprising a fluid delivery device having two or more sets of outlets.

BACKGROUND

A fluid delivery device having two or more sets of outlets may offer a user a selection of a plurality of spray patterns or spray modes, depending upon which set of outlets or combination of sets of outlets is in operation at a given time.

However, to maintain a high quality user experience across any and all combinations of spray patterns or spray modes, it may be necessary to adjust the temperature and/or flow rate of the water being supplied to the fluid delivery device.

BRIEF DESCRIPTION OF THE DRAWINGS

Embodiments of the invention will now be described, by way of example only, with reference to the accompanying drawings.

DETAILED DESCRIPTION OF THE DRAWINGS

Figure 1:
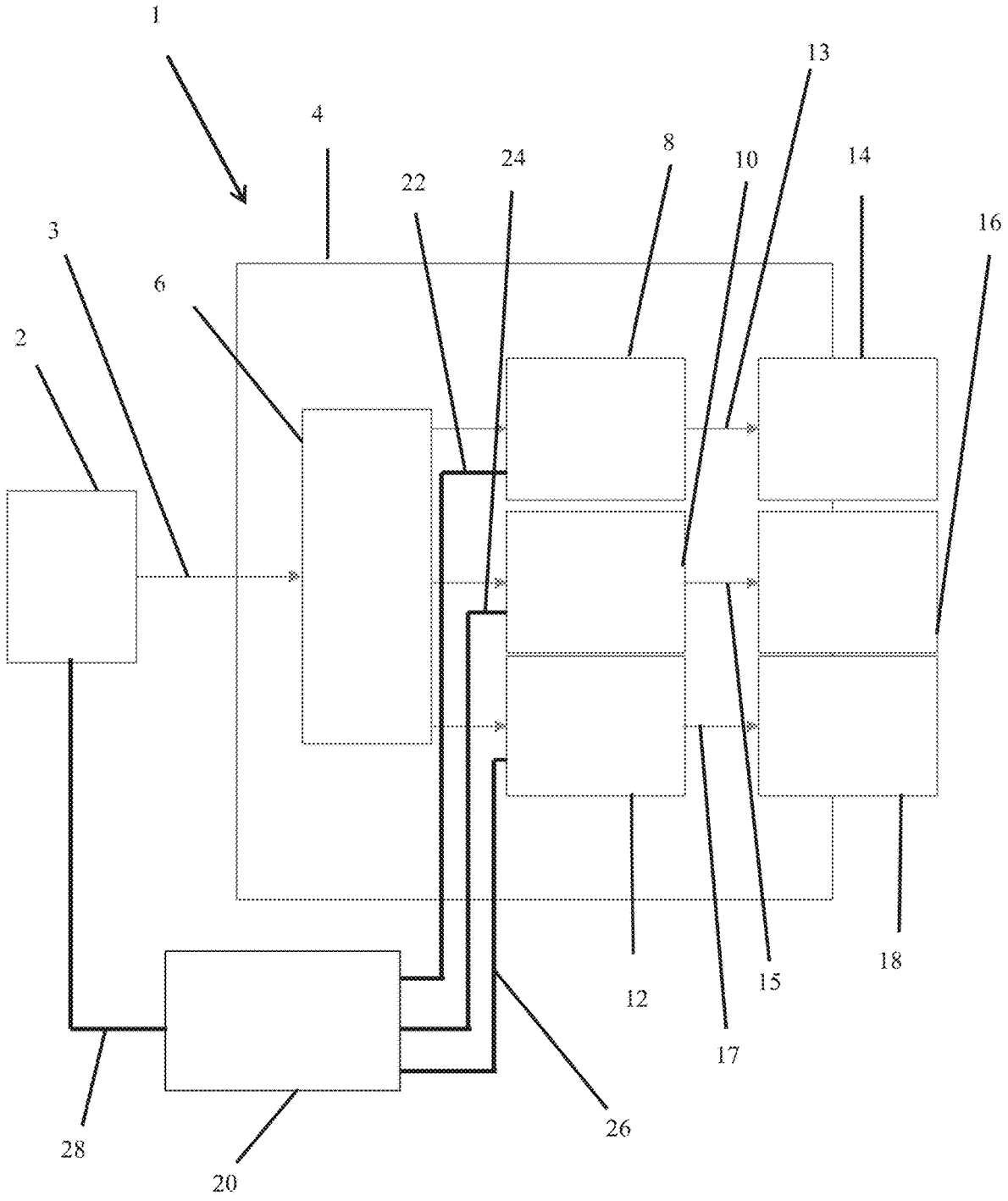
FIG. 1 shows a schematic view of an example plumbing system.

A first aspect provides a plumbing system comprising: a means operable to provide a principal stream having a controlled temperature and flow rate; a fluid delivery device downstream of the means operable to provide a principal stream having a controlled temperature and flow rate, the fluid delivery device having two or more sets of outlets, each of the two or more sets of outlets comprising at least two outlets, an outlet operating valve being disposed upstream of each set of outlets and being operable to control fluid flow to the set of outlets downstream thereof; a communication link between the means operable to provide a principal stream having a controlled temperature and flow rate and the outlet operating valves; wherein the means operable to provide a principal stream having a controlled temperature and flow rate is configured, in use, to adjust the temperature and flow rate of the principal stream in dependence upon which set of outlets or combination of sets of outlets is in operation at a given time.

The fluid delivery device may comprise a spray head, e.g. a spray head for a shower.

The means operable to provide a principal stream having a controlled temperature and flow rate may comprise, for example, an instantaneous water heater, a mixer valve, or the like. The mixer valve may be a digital mixer valve. The mixer valve may be a thermostatic mixer valve.

The fluid delivery device may comprise up to five sets of outlets, up to 10 sets of outlets or up to 20 sets of outlets.

For example, the fluid delivery device may comprise a first set of outlets, a second set of outlets and a third set of outlets. The fluid delivery device may comprise one or more further sets of outlets, e.g. a fourth set of outlets.

One or more of the sets of outlets, e.g. all of the sets of outlets, may be housed within the fluid delivery device.

Each set of outlets may be configured to provide a different spray pattern from the other set(s) of outlets.

Any given set of outlets may comprise up to 10 outlets, up to 20 outlets, up to 50 outlets or up to 100 outlets.

A nozzle may be present in one or more of the outlets.

The fluid delivery device may comprise one or more spray faces. One or more outlets may be present in each spray face.

The outlet operating valve disposed upstream of each set of outlets may comprise any suitable valve operable to permit or prevent fluid flow to the set of outlets downstream thereof. Each outlet operating valve may be operable independently of any other outlet operating valves. In this way, one or more outlet operating valves may be open at any time and one or more outlet operating valves may be closed at any time. Any of the outlet operating valves may be open or closed at any one time, in use. In this way, one or more individual spray patterns or spray modes may be produced by the corresponding set of outlets or combination of sets of outlets.

One or more of the outlet operating valves may comprise a solenoid valve, e.g. a bistable solenoid valve.

In an implementation, each outlet operating valve may be electrically operated. Each of the outlet operating valves may be configured to have an off state and an on state. An off state may be when no electrical signal is transmitted to the outlet operating valve. An on state may be when an electrical signal is transmitted to the outlet operating valve.

One or more of the outlet operating valves may comprise a solenoid valve. Each solenoid valve may be a bistable solenoid valve. Each bistable solenoid valve may be operable to change between an off state and an on state, and vice versa, when an electrical pulse is sent to each valve respectively. In this way, each solenoid valve may be configured to move between a retracted and extended position when an electrical pulse is supplied, and vice versa. Each solenoid valve may be configured to remain in either a retracted or extended state in between electrical pulses being sent.

At least one of the one or more outlet operating valves may be configured such that the valve is open in an off state. In this way, in the event of no electrical power being supplied to the outlet operating valves, e.g. due to a power cut or a flat battery, at least one spray pattern will be produced if a flow of water is conveyed to the outlet operating valves.

The communication link between the means operable to provide a principal stream and the outlet operating valves may comprise any suitable means for transmitting data. The communication link may comprise a wired connection or a wireless connection.

The plumbing system may comprise an electronic controller. The electronic controller may be operably connected to the means operable to provide a principal stream and the outlet operating valves. The electronic controller may be configured to transmit and/or receive electronic signals to and/or from the means operable to provide a principal stream and/or the outlet operating valves.

The plumbing system may comprise a user input mechanism. The user input mechanism may comprise any suitable mechanism operable to allow a user to input one or more commands to the electronic controller.

The electronic controller may be configured to transmit an electronic signal to any of the outlet operating valves to open or close the outlet operating valve. The electronic controller may be configured to open or close any combination of outlet operating valves. In this way, the spray pattern produced may comprise any individual set of outlets or combination of sets of outlets.

The means operable to provide a principal stream may be configured, in use, to increase the temperature, decrease the temperature and/or maintain the same fluid temperature upon operation of any outlet operating valves. The means operable to provide a principal stream may be configured, in use, to increase the flow rate, decrease the flow rate and/or maintain the same fluid flow rate upon operation of any outlet operating valves.

The plumbing system may be configured such that a user may change the spray pattern, fluid flow rate and/or fluid temperature. A user may be able to change the spray pattern, fluid flow rate and/or fluid temperature through the user input mechanism or any other suitable means.

The controller may be operable to transmit a signal to the means operable to provide a principal stream to raise or lower the fluid temperature. The controller may be operable to transmit a signal to the means operable to provide a principal stream to raise or lower the fluid flow rate.

The plumbing system may comprise a means for detecting the temperature of the principal stream. The means for detecting the temperature of the principal stream may be operably connected to the electronic controller.

The plumbing system may comprise a means for detecting the flow rate of the principal stream. The means for detecting the flow rate of the principal stream may be operably connected to the electronic controller.

The controller may be configured such that upon changing the spray pattern produced from the spray head, the controller transmits a signal to the means operable to provide a principal stream to raise or lower the fluid temperature. The controller may be configured such that upon changing the spray pattern produced from the spray head, the controller transmits a signal to the means operable to provide a principal stream to raise or lower the fluid flow rate.

The controller may be configured such that upon changing the fluid flow rate, the controller transmits a signal to the means operable to provide a principal stream to raise or lower the fluid temperature.

The controller may be configured such that upon changing the fluid temperature, the controller transmits a signal to the means operable to provide a principal stream to raise or lower the fluid flow rate.

The user input mechanism may comprise one or more dials, levers, handles, buttons, touchscreens or the like.

The plumbing system may comprise one or more lighting elements operable to emit light, in use. The fluid delivery device may comprise one or more lighting elements operable to emit light, in use. For example, the lighting element (s) may be disposed on or in the vicinity of the or a spray face.

One or more of the lighting elements may be operably connected to the electronic controller. Accordingly, operation of one or more of the lighting elements, e.g. all of the lighting elements, may be controlled in conjunction with operation of the sets of outlets. For instance, one or more characteristics of the light emitted by one or more of the lighting elements may be varied, in use, depending upon which set of outlets or combination of sets of outlets is in operation at any given time. Alternatively or additionally, one or more characteristics of the light emitted by one or more of the lighting elements may be varied, in use, depending upon the temperature of the fluid, e.g. the temperature of the principal stream. The characteristic(s) of the light emitted by one or more of the lighting elements that may be varied, in use, may include, for example, colour, brightness, intensity, sequence or pattern, e.g. a pulsed or flashing pattern.

By controlling one or more of the characteristics of the light emitted by one or more of the lighting elements in conjunction with operation of the sets of outlets, the plumbing system may provide a user with additional information, e.g. visual information relating to water temperature, and/or a multi-sensory experience.

In an example implementation, one of the lighting elements may extend completely around a perimeter of the or a spray face. The lighting element extending completely around the perimeter of the or a spray face may be an annular lighting element or a light ring.

One or more lighting elements may be located substantially centrally upon or within the spray face.

One or more lighting elements may be located within a recess located at least partially within the spray face, e.g. located within a recess located near to or at the centre of the spray face.

One or more lighting elements may extend a distance across the spray face. For example, one or more of the lighting elements may extend across at least a portion of a diameter of the spray face.

One or more of the lighting elements may comprise one or more light emitting diodes (LEDs).

Electrical power may be required to operate various components of the plumbing system, for example the solenoid valve(s) and/or the lighting element(s), if present. For instance, electrical power may be supplied to one or more components housed within the fluid delivery device from a remote power source such as a mains electricity supply. Alternatively or additionally, electrical power may be supplied to one or more components housed within the fluid delivery device from a local power source, e.g. one or more batteries disposed at least partially within the fluid delivery device. One or more of the batteries may be rechargeable.

In another implementation, the plumbing system may comprise one or more turbine generators arranged to be driven, in use, by a fluid stream such as the principal stream. Electricity produced by the turbine generator(s) may be utilised, for example, to charge a battery and/or to power one or more lighting elements.

The turbine generator(s) may be housed at least partially within the fluid delivery device The plumbing system may comprise a manifold configured to receive the principal stream at a manifold inlet and having a plurality of branches, each branch leading to a manifold outlet, wherein an outlet operating valve is downstream of each manifold outlet.

Except where mutually exclusive, any of the features of any of the above-described aspects may be employed mutatis mutandis in any of the other above-described aspects.

FIG. 1 shows a schematic view of a plumbing system 1.

The plumbing system 1 comprises a digital mixer valve 2 operable to provide a principal stream 3 having a controlled temperature and flow rate. The digital mixer valve 2 receives a first inlet stream (not shown) of hot water and a second inlet stream (not shown) of cold water. The digital mixer valve 2 operates to mix the first inlet stream and the second inlet stream in the required proportions to provide the principal stream 3 having a controlled temperature and flow rate.

A manifold 6 is in fluid communication with the digital mixer valve 2. The manifold 6 receives the principal stream 3 at a manifold inlet. The manifold 6 has a first branch leading to a first manifold outlet, a second branch leading to a second manifold outlet and a third branch leading to a third manifold outlet. A first outlet stream 13 exits the first manifold outlet. A second outlet stream 15 exits the second manifold outlet. A third outlet stream 17 exits the third manifold outlet.

A first set of outlets 14 is in fluid communication with the first manifold outlet. The first set of outlets 14 comprises a plurality of outlets. The first set of outlets 14 provides a first spray pattern.

A first outlet operating valve 8 is disposed between the manifold 6 and the first set of outlets 14. The first outlet operating valve 8 is operable to permit or prevent flow of the first outlet stream 13 to the first set of outlets 14. In an example implementation, the first outlet operating valve 8 may comprise a solenoid valve, e.g. a bistable solenoid valve.

A second set of outlets 16 is in fluid communication with the second manifold outlet. The second set of outlets 16 comprises a plurality of outlets. The second set of outlets 16 provides a second spray pattern.

A second outlet operating valve 10 is disposed between the manifold 6 and the second set of outlets 16. The second outlet operating valve 10 is operable to permit or prevent flow of the second outlet stream 15 to the second set of outlets 16. In an example implementation, the second outlet operating valve 10 may comprise a solenoid valve, e.g. a bistable solenoid valve.

A third set of outlets 18 is in fluid communication with the third manifold outlet. The third set of outlets 18 comprises a plurality of outlets. The third set of outlets 18 provides a third spray pattern.

A third outlet operating valve 12 is disposed between the manifold 6 and the third set of outlets 18. The third outlet operating valve 12 is operable to permit or prevent flow of the third outlet stream 17 to the third set of outlets 18. In an example implementation, the third outlet operating valve 12 may comprise a solenoid valve, e.g. a bistable solenoid valve.

The manifold 6, the first outlet operating valve 8, the second outlet operating valve 10, the third outlet operating valve 12, the first set of outlets 14, the second set of outlets 16 and the third set of outlets 18 are housed within a spray head 4 for an overhead shower or a handheld shower. The digital mixer valve 2 may be located remotely from the spray head 4, e.g. in a wall cavity or a ceiling cavity. Alternatively, the digital mixer valve 2 may be housed at least partially within the spray head 4.

An electronic controller 20 is operably connected to the first outlet operating valve 8, the second outlet operating valve 10, the third outlet operating valve 12 and the digital mixer valve 2.

A first data connection 22 connects the first outlet operating valve 8 to the electronic controller 20. The first data connection 22 is configured to carry signals, in use, in both directions between the first outlet operating valve 8 and the electronic controller 20.

A second data connection 24 connects the second outlet operating valve 10 to the electronic controller 20. The second data connection 24 is configured to carry signals, in use, in both directions between the second outlet operating valve 10 and the electronic controller 20.

A third data connection 26 connects the third outlet operating valve 12 to the electronic controller 20. The third data connection 26 is configured to carry signals, in use, in both directions between the third outlet operating valve 12 and the electronic controller 20.

A fourth data connection 28 connects the electronic controller 20 to the digital mixer valve 2. The fourth data connection 28 is configured to carry signals, in use, in both directions between the electronic controller 20 and the digital mixer valve 2.

It will be appreciated that the plumbing system 1 includes a communication link between the first outlet operating valve 8 and the digital mixer valve 2, a communication link between the second outlet operating valve 10 and the digital mixer valve 2 and a communication link between the third outlet operating valve 12 and the digital mixer valve 2.

As a consequence of the presence of these communication links, the digital mixer valve 2 is configured to adjust, in use, the temperature and flow rate of the principal stream in dependence upon which one or combination of the first set of outlets 14, the second set of outlets 16 and the third set of outlets 18 is in operation at a given time.

The plumbing system 1 comprises a user input mechanism (not shown). The user input mechanism comprises any suitable means operable to allow a user to input one or more commands to the electronic controller 20. The user input mechanism, in some implementations, may comprise one or more dials, levers, handles, buttons, touchscreens or the like.

It will be appreciated that the digital mixer valve 2 is an example of a means operable to provide a principal stream having a controlled temperature and flow rate. Any other means operable to provide a principal stream having a controlled temperature and flow rate may be employed instead of a digital mixer valve. For example, the means operable to provide a principal stream having a controlled temperature and flow rate may include an instantaneous water heater. The instantaneous water heater may receive a single inlet stream of cold water. The instantaneous water heater may operate to heat the cold water and regulate water flow therethrough to provide the principal stream having a controlled temperature and flow rate. The term digital mixer valve 2, as used here, will be understood to include all possible mechanisms that provide a principal stream having a controlled temperature and flow rate, including but not limited to an instantaneous water heater.

In an example implementation, the spray head 4 may comprise a spray face in which the first set of outlets 14, the second set of outlets 16 and the third set of outlets 18 are at least partially disposed. The spray head 4 may comprise one or more lighting elements operable to emit light, in use. For example, the lighting element(s) may be disposed on or in the vicinity of the spray face.

One or more of the lighting elements may be operably connected to the electronic controller 20. Accordingly, operation of one or more of the lighting elements, e.g. all of the lighting elements, may be controlled in conjunction with operation of the first set of outlets 14, the second set of outlets 16 and the third set of outlets 18. For instance, one or more characteristics of the light emitted by one or more of the lighting elements may be varied, in use, depending upon which combination of the first set of outlets 14, the second set of outlets 16 and the third set of outlets 18 is in operation at any given time. Alternatively or addition ally, one or more characteristics of the light emitted by one or more of the lighting elements may be varied, in use, depending upon the temperature of the water, e.g. the temperature of the principal stream. The characteristic(s) of the light emitted by one or more of the lighting elements that may be varied, in use, may include, for example, colour, brightness, intensity, sequence or pattern, e.g. a pulsed or flashing pattern.

By controlling one or more of the characteristics of the light emitted by one or more of the lighting elements in conjunction with operation of the first set of outlets, the second set of outlets and the third set of outlets, the plumbing system may provide a user with additional information, e.g. visual information relating to water temperature, and/or a multi-sensory experience.

In some implementations, one or more further components for providing a sensory stimulus may be operably connected to the electronic controller 20. Such further components for providing a sensory stimulus may include one or more sound devices, or devices configured to provide one or more aromas, for example. One or more of the further components for providing a sensory stimulus may be connectable to the spray head. When connected to the spray head, the further component(s) for providing a sensory stimulus may be housed at least partially within the spray head.

In an example implementation, one of the lighting elements may extend completely around a perimeter of the spray face. The lighting element extending completely around the perimeter of the spray face may be an annular lighting element or a light ring.

One or more of the lighting elements may comprise one or more light emitting diodes (LEDs).

Electrical power may be required to operate various components of the plumbing system, for example the solenoid valve(s) and/or the lighting element(s), if present. For instance, electrical power may be supplied to one or more components housed within the spray head 4 from a remote power source such as a mains electricity supply. The electrical power may be supplied to one or more components housed within the spray head 4 via any suitable means, such as via the fourth data connection 28. Alternatively or additionally, electrical power may be supplied to one or more components housed within the spray head 4 from a local power source, e.g. one or more batteries disposed at least partially within the spray head 4. One or more of the batteries may be rechargeable.

In another implementation, the plumbing system may comprise one or more turbine generators arranged to be driven, in use, by the principal stream, the first outlet stream, the second outlet stream and/or the third outlet stream. Electricity produced by the turbine generator(s) may be utilised, for example, to charge a battery and/or to power one or more lighting elements.

The turbine generator(s) may be housed at least partially within the spray head 4.

Some example operations of the plumbing system 1 will now be described.

In use, a user may operate the user input mechanism in order to select a higher or lower temperature. A user input signal is transmitted from the user input mechanism to the controller 20. The controller 20 then sends a command signal via the fourth data connection 28 to the digital mixer valve 2 such that the digital mixer valve 2 operates to adjust the temperature of the principal stream 3 to the higher or lower temperature selected by the user.

In use, a user may operate the user input mechanism, in order to select any one or combination of the first set of outlets 14, the second set of outlets 16 and the third set of outlets 18 to provide a desired spray pattern or spray mode.

To change the spray pattern selected, the controller 20 sends command signals to the relevant outlet operating valves, in order to open and/or close the required outlet operating valves, in order to produce the user-selected spray pattern.

Upon changing the spray pattern, the controller 20 may send one or more command signals to the digital mixer valve 2, in order to change the temperature and/or flow rate of the principal stream 3. For example, upon a user-selected change from the second set of outlets 16 to the first set of outlets 14, the controller 20 may send a command signal to the digital mixer valve 2 to maintain the flow rate and increase the temperature of the principal stream 3. For example, upon a user-selected change from the first set of outlets 14 to the third set of outlets 18, the controller 20 may send a command signal to the digital mixer valve 2 to maintain the temperature and decrease the flow rate of the principal stream 3.

Figure 2:
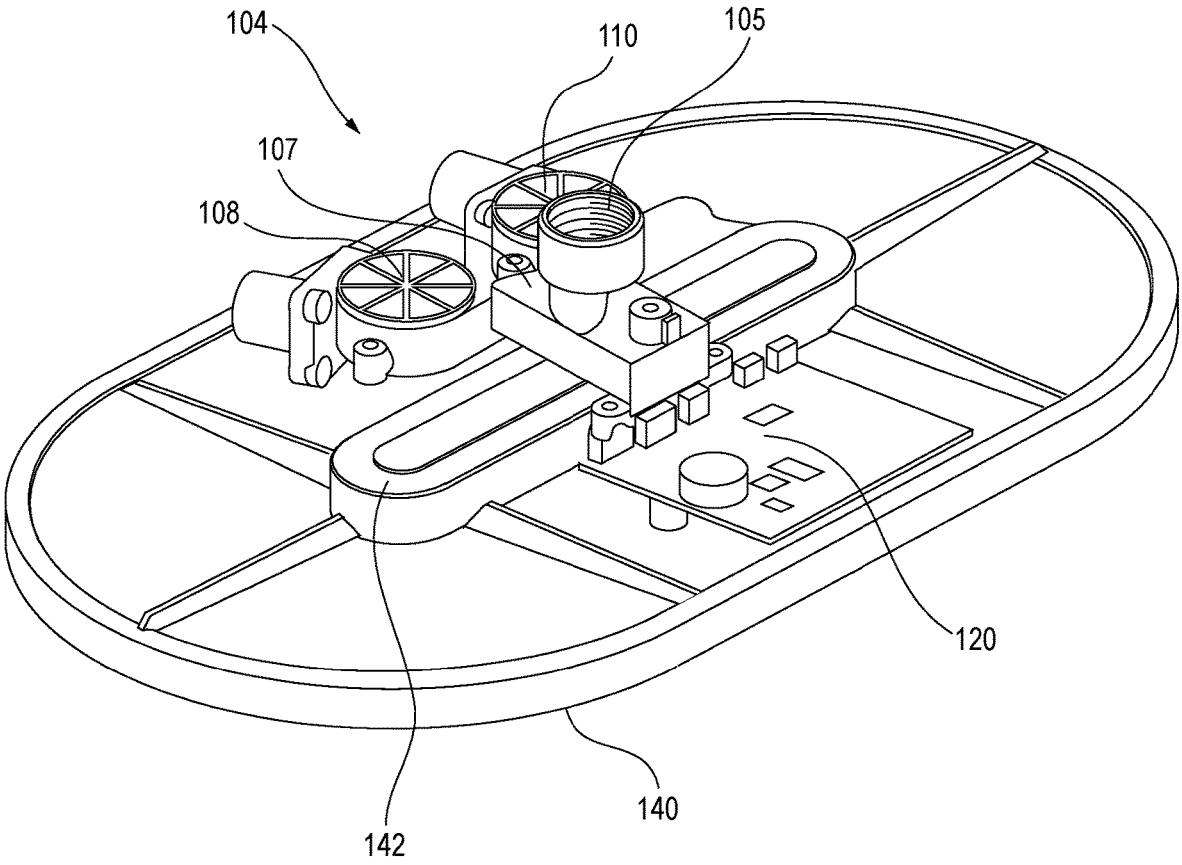
FIG. 2 shows a first cut-away view of a spray head for use in an example plumbing system.
Figure 3:
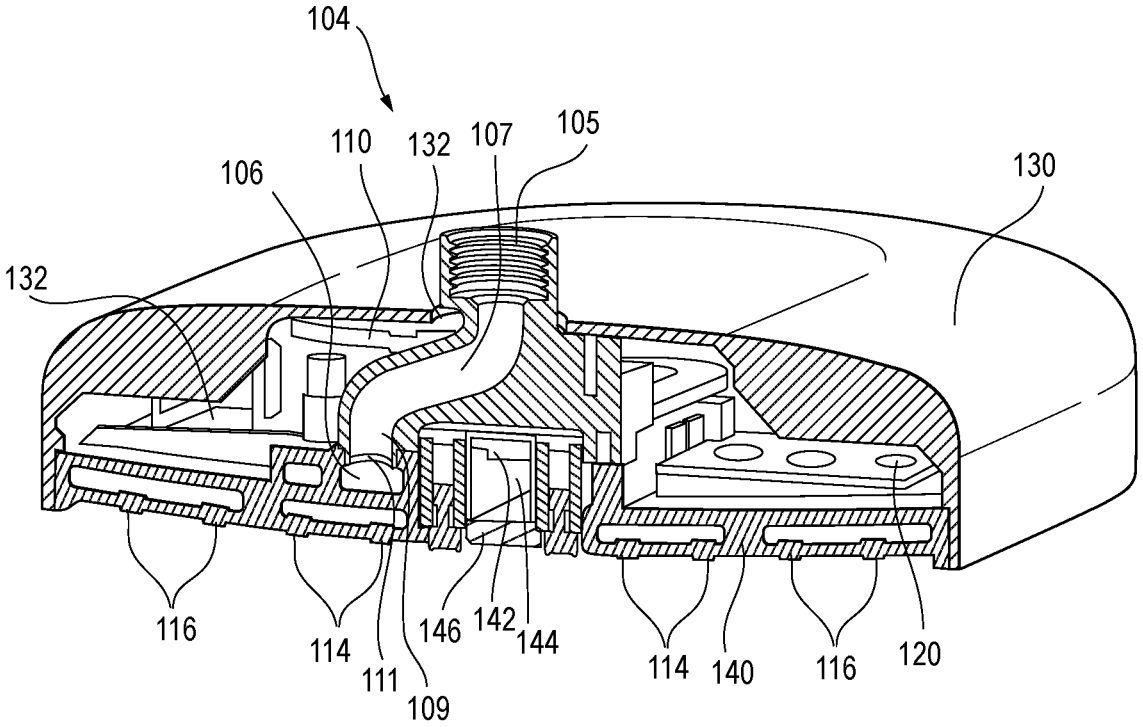
FIG. 3 shows a second cut-away view of an example spray head.

FIGS. 2 and 3 show an example of a spray head 104 for an overhead shower. The spray head 104 may form part of a plumbing system such as the plumbing system 1 described herein.

A connecting tube 107 has a first end 105 adapted to be connected to a water supply pipe (not shown) for conveying a principal fluid stream having a controlled temperature and flow rate into the shower head 104. For example, the water supply pipe may protrude from a ceiling in an ablutionary setting or the water supply pipe may comprise an arm extending from a wall or a riser bar.

A second end 109 of the connecting tube 107 communicates with a manifold 106. The manifold 106 has a manifold inlet 111 connected to the second end 109 of the connecting tube 107. The manifold inlet 111 leads to a manifold chamber. The manifold 106 comprises a first manifold branch leading from the manifold chamber to a first manifold outlet and a second manifold branch leading from the manifold chamber to a second manifold outlet.

In use, a first outlet stream exits the first manifold outlet and a second outlet stream exits the second manifold outlet.

A first set of outlets 114 is in fluid communication with the first manifold outlet. The first set of outlets 114 comprises a plurality of outlets. The first set of outlets 114 provides a first spray pattern.

A first outlet operating valve 108 is disposed between the first manifold outlet [Ref] and the first set of outlets 114. The first outlet operating valve 108 is operable to permit or prevent flow of the first outlet stream to the first set of outlets 114. In an example implementation, the first outlet operating valve 108 may comprise a solenoid valve, e.g. a bistable solenoid valve.

A second set of outlets 116 is in fluid communication with the second manifold outlet. The second set of outlets 116 comprises a plurality of outlets. The second set of outlets 116 provides a second spray pattern.

A second outlet operating valve 110 is disposed between the second manifold outlet and the second set of outlets 116. The second outlet operating valve 110 is operable to permit or prevent flow of the second outlet stream to the second set of outlets 116. In an example implementation, the second outlet operating valve 110 may comprise a solenoid valve, e.g. a bistable solenoid valve.

The manifold 106, the first outlet operating valve 108, the second outlet operating valve 110, the first set of outlets 114 and the second set of outlets 116 are housed within the spray head 104.

An electronic controller comprises a printed circuit board 120 with control circuitry thereon. The printed circuit board 120 is housed within the spray head 104. The printed circuit board 120 is operably connected to the first outlet operating valve 108, the second outlet operating valve 110 and a lighting element 142 comprising an LED light strip. When the spray head 104 is installed as part of a plumbing system, the printed circuit board 120 is configured to be operably connected to a means operable to provide a principal stream having a controlled flow rate and temperature, e.g. a digital mixer valve, located upstream of the spray head 104.

The spray head 104 comprises a spray face 140 in which the first set of outlets 114 and the second set of outlets 116 are disposed. The first set of outlets 114 is located centrally on the spray face 140. The second set of outlets 116 surrounds the first set of outlets 114. The lighting element 142 is located in a recess 144 extending a distance across a central portion of the spray face 140. The recess 144 is covered with a transparent cover 146, which protects the lighting element 142 by preventing water from entering the recess 144 and allows light from the lighting element 142 to pass therethrough. The first set of outlets 114 surrounds the recess 144.

The spray head 104 comprises an outer casing 130. The outer casing 130 is connected to the spray face 140 so as to provide an internal volume 132. A watertight seal is provided between the outer casing 130 and the spray face 140 to prevent water from entering the internal volume 132. In the implementation shown, the printed circuit board 120, the first outlet operating valve 108 and the second outlet operating valve 110 are housed within the internal volume 132. The outer casing 130 comprises a rear-facing aperture 134 through which the connecting tube 107 passes. The first end 105 of the connecting tube 107 is located outside the internal volume 132 and the second end 109 of the connecting tube 107 is located inside the internal volume 132.

A first data connection connects the first outlet operating valve 108 to the printed circuit board 120. The first data connection is configured to carry signals, in use, in both directions between the first outlet operating valve 108 and the printed circuit board 120.

A second data connection connects the second outlet operating valve 110 to the printed circuit board 120. The second data connection is configured to carry signals, in use, in both directions between the second outlet operating valve 110 and the printed circuit board 120.

When the spray head 104 is installed as part of a plumbing system, a further data connection connects the printed circuit board 120 to the means operable to provide a principal stream having a controlled flow rate and temperature, e.g. the digital mixer valve, located upstream of the spray head 104. The further data connection is configured to carry signals, in use, in both directions between the printed circuit board 120 and the means operable to provide a principal stream having a controlled flow rate and temperature.

The lighting element 142 is operably connected to the printed circuit board 120. Accordingly, operation of the lighting element 142 may be controlled in conjunction with operation of the first set of outlets 114 and the second set of outlets 116. For instance, one or more characteristics of the light emitted by the lighting element 142 may be varied, in use, depending upon which combination of the first set of outlets 114 and the second set of outlets 116 is in operation at any given time.

It will be appreciated that in example implementations the spray head 104 may comprise any number of outlet operating valves and corresponding sets of outlets. In the implementation shown in FIGS. 2 and 3, two outlet operating valves are shown, but it will be appreciated that the spray head 104 may include any number of outlet operating valves.

A user input mechanism (not shown) may be operably connected to the printed circuit board 120. The user input mechanism may comprise any suitable means operable to allow a user to input one or more commands to the electronic controller. The user input mechanism, in some implementations, may comprise one or more dials, levers, handles, buttons, touchscreens or the like.

By controlling one or more of the characteristics of the light emitted by the lighting element 142 in conjunction with operation of the first set of outlets 114 and the second set of outlets 116, a plumbing system comprising the spray head 104 may provide a user with additional information, e.g. visual information relating to water temperature, and/or a multi-sensory experience.

In some implementations, one or more further components for providing a sensory stimulus may be operably connected to the electronic controller. Such further components for providing a sensory stimulus may include one or more sound devices, or devices configured to provide one or more aromas, for example. One or more of the further components for providing a sensory stimulus may be connectable to the spray head. When connected to the spray head, the further component(s) for providing a sensory stimulus may be housed at least partially within the spray head.

Electrical power may be required to operate various components of the spray head 104, for example the solenoid valves and/or the lighting element. For instance, electrical power may be supplied to one or more components housed within the spray head 104 from a remote power source such as a mains electricity supply. The electrical power may be supplied to one or more components housed within the spray head 104 via any suitable means, such as via the further data connection. Alternatively or additionally, electrical power may be supplied to one or more components housed within the spray head 104 from a local power source, e.g. one or more batteries disposed at least partially within the spray head 104. One or more of the batteries may be rechargeable.

In another implementation, the spray head may comprise one or more turbine generators arranged to be driven, in use, by the principal stream, the first outlet stream and/or the second outlet stream. Electricity produced by the turbine generator(s) may be utilised, for example, to charge a battery and/or to power the lighting element.

In an example plumbing system, a digital mixer valve may be provided along with at least two outlet operating valves each in fluid communication with the digital mixer valve. The digital mixer valve may control fluid flow, including temperature and pressure of the fluid flow, to each operating valve. A respective set of outlets may be in fluid communication with each outlet operating valve, and each outlet operating valve may control fluid flow to its respective set of outlets. An electronic controller may be in communication with the digital mixer valve and the at least two outlet operating valves. The electronic controller may be configured to control the digital mixer valve to adjust the temperature and pressure of the fluid flow based on which of the at least two outlet operating valves are open. The sets of outlets may be positioned in a spray head. Each outlet operating valve may be operable independently of any other outlet operating valve.

In an example method, an electronic controller communicates with at least two outlet operating valves regarding which of the at least two operating valves are open, to permit fluid flow to a set of outlets associated with each respective outlet operating valve. The electronic controller instructs a digital mixer valve to adjust a temperature and pressure of fluid flow provided to the at least two outlet operating valves based on which outlet operating valves are open. The temperature and pressure of the fluid flow is adjusted via the digital mixer valve based on the instruction from the digital mixer valve. The temperature and pressure adjusted fluid flow is supplied from the digital mixer valve to those of the at least two operating valves that are open.

Various modifications can be made to the example embodiments described herein without departing from the scope of the invention.

Except where mutually exclusive, any of the features may be employed separately or in combination with any other features and the disclosure extends to all combinations and sub-combinations of one or more features disclosed herein.

The invention claimed is:

1. A plumbing system comprising:

a digital mixer valve providing a principal stream having a controlled temperature and flow rate;

a fluid delivery device downstream of the digital mixer valve, the fluid delivery device having two or more sets of outlets and an outlet operating valve, each of the two or more sets of outlets comprising at least two outlets, and the outlet operating valve being disposed upstream of each set of outlets and controlling fluid flow to the set of outlets downstream thereof;

a communication link between the digital mixer valve and the outlet operating valves;

wherein the digital mixer valve is configured, in use, to adjust a temperature and flow rate of the principal stream in dependence upon which set of outlets or combination of sets of outlets is in operation at a given time;

wherein at least one of:

the digital mixer valve adjusts a temperature of the principal stream based on a selected flow rate; and the digital mixer valve adjusts a flow rate of the principal stream based on a selected temperature.

2. The plumbing system according to claim 1, wherein the fluid delivery device comprises a spray head.

3. The plumbing system according to claim 1, wherein the digital mixer valve is an instantaneous water heater.

4. The plumbing system according to claim 1, wherein the fluid delivery device comprises up to 20 sets of outlets.

5. The plumbing system according to claim 1, wherein one or more of the sets of outlets are housed within the fluid delivery device.

6. The plumbing system according to claim 1, wherein each outlet operating valve is operable independently of any other outlet operating valve.

7. The plumbing system according to claim 1, wherein one or more of the outlet operating valves comprises a solenoid valve.

8. The plumbing system according to claim 1, further including an electronic controller operably connected to the digital mixer valve and the outlet operating valves.

9. The plumbing system according to claim 8, further including a user input mechanism allowing a user to input one or more commands to the electronic controller.

10. The plumbing system according to claim 8, further including one or more lighting elements emitting light in use.

11. The plumbing system according to claim 10, wherein the fluid delivery device comprises one or more lighting elements emitting light in use.

12. The plumbing system according to claim 10, wherein one or more of the lighting elements is/are operably connected to the electronic controller.

13. The plumbing system according to claim 10, wherein the electronic controller controls operation of one or more of the lighting elements in conjunction with operation of the sets of outlets.

14. The plumbing system according to claim 13, wherein the electronic controller varies one or more characteristics of light emitted by one or more of the lighting elements, in use, depending upon which set of outlets or combination of sets of outlets is in operation at any given time.

15. The plumbing system according to claim 13, wherein the electronic controller varies one or more characteristics of the light emitted by one or more of the lighting elements, in use, depending upon the temperature of a fluid stream such as the principal stream.

16. The plumbing system according to claim 1, further including one or more turbine generators driven, in use, by a fluid stream.

17. A plumbing system comprising:

a digital mixer valve;

at least two outlet operating valves each in fluid communication with the digital mixer valve, the digital mixer valve controlling fluid flow, including temperature and pressure of the fluid flow, to each operating valve;

a respective set of outlets in fluid communication with each said outlet operating valve, wherein each outlet operating valve controls fluid flow to its respective set of outlets; and an electronic controller in communication with the digital mixer valve and the at least two outlet operating valves, the electronic controller configured to control the digital mixer valve to adjust the temperature and pressure of the fluid flow based on which of the at least two outlet operating valves are open;

wherein at least one of:

the digital mixer valve adjusts a temperature of the principal stream based on a selected flow rate; and the digital mixer valve adjusts a flow rate of the principal stream based on a selected temperature.

18. The plumbing system of claim 17, wherein the sets of outlets are positioned in a spray head.

19. The plumbing system of claim 17, wherein each outlet operating valve is operable independently of any other outlet operating valve.

20. A method comprising:

communicating, between an electronic controller and at least two outlet operating valves, which of the at least two operating valves are open to permit fluid flow to a set of outlets associated with each respective outlet operating valve;

instructing, by the electronic controller, a digital mixer valve to adjust a temperature and pressure of fluid flow provided to the at least two outlet operating valves based on which outlet operating valves are open;

adjusting the temperature and pressure of the fluid flow via the digital mixer valve based on the instruction from the digital mixer valve; and supplying the temperature and pressure adjusted fluid flow from the digital mixer valve to those of the at least two operating valves that are open;

wherein at least one of:

the digital mixer valve adjusts a temperature of the principal stream based on a selected flow rate; and the digital mixer valve adjusts a flow rate of the principal stream based on a selected temperature.

* * * * *